US011426034B2

(12) United States Patent
Knight

(10) Patent No.: US 11,426,034 B2
(45) Date of Patent: Aug. 30, 2022

(54) REDUCED FORCE, SEALING VENT FOR SQUEEZE FOAMER

(71) Applicant: RIEKE LLC, Auburn, IN (US)

(72) Inventor: Simon Christopher Knight, Bridgend (GB)

(73) Assignee: RIEKE LLC, Auburn, IN (US)

( * ) Notice: Subject to any disclaimer, the term of this patent is extended or adjusted under 35 U.S.C. 154(b) by 51 days.

(21) Appl. No.: 16/960,965

(22) PCT Filed: Jan. 8, 2019

(86) PCT No.: PCT/US2019/012670

§ 371 (c)(1),
(2) Date: Jul. 9, 2020

(87) PCT Pub. No.: WO2019/139890

PCT Pub. Date: Jul. 18, 2019

(65) Prior Publication Data

US 2020/0329923 A1 Oct. 22, 2020

Related U.S. Application Data

(60) Provisional application No. 62/615,041, filed on Jan. 9, 2018.

(51) Int. Cl.
*A47K 5/122* (2006.01)
*B05B 11/00* (2006.01)
(Continued)

(52) U.S. Cl.
CPC ..... *A47K 5/122* (2013.01); *A47K 5/14* (2013.01); *B01F 23/235* (2022.01);
(Continued)

(58) Field of Classification Search
CPC .... A47K 5/122; A47K 5/14; B05B 11/00442; B05B 11/04; B05B 11/3043; B05B 7/0037; B01F 3/04446; B01F 5/0693
See application file for complete search history.

(56) References Cited

U.S. PATENT DOCUMENTS 4,688,944 A 8/1987 Mumenthaler
5,443,569 A * 8/1995 Uehira ..... B05B 7/0031 222/190

(Continued)

FOREIGN PATENT DOCUMENTS

WO 2017093577 6/2017

OTHER PUBLICATIONS

Patent Cooperation Treaty (PCT), International Search Report and Written Opinion for Application PCT/US2019/012670 filed on Jan. 8, 2019, dated Apr. 8, 2019, International Searching Authority, US.

(Continued)

*Primary Examiner* — Jeremy Carroll
(74) *Attorney, Agent, or Firm* — McDonald Hopkins LLC

(57) ABSTRACT

A sealing vent for a foaming dispenser associated with a squeeze foaming container is described. The vent has an annular structure, with a central aperture encased by a multi-tiered disc section connected to inner facing of a thickened, axial wall. An upward angled, outer flange is connected on an outer facing of the axial wall, and the outer flange is attached at a lower elevation along the axial wall in comparison to the disc section.

22 Claims, 4 Drawing Sheets

(51) Int. Cl.

| | |
|---|---|
| ***A47K 5/14*** | (2006.01) |
| ***B05B 7/00*** | (2006.01) |
| ***B05B 11/04*** | (2006.01) |
| ***B01F 23/235*** | (2022.01) |
| ***B01F 25/452*** | (2022.01) |
| ***B01F 33/501*** | (2022.01) |

(52) U.S. Cl.
CPC .... *B01F 25/4523* (2022.01); *B01F 33/50111* (2022.01); *B05B 7/0037* (2013.01); *B05B 11/00442* (2018.08); *B05B 11/04* (2013.01); *B05B 11/3043* (2013.01)

(56) References Cited

U.S. PATENT DOCUMENTS

| | | | | |
|---|---|---|---|---|
| 7,850,048 | B2 * | 12/2010 | Arminak | B05B 11/3069 222/190 |
| 8,056,769 | B2 | 11/2011 | van der Heijden | |
| 9,718,070 | B2 | 8/2017 | Arminak et al. | |
| 2009/0001100 | A1 | 1/2009 | van der Heijden | |
| 2010/0001024 | A1 * | 1/2010 | van der Heijden | B05B 7/0037 222/190 |
| 2012/0241477 | A1 * | 9/2012 | Uehira | B05B 11/0064 222/190 |
| 2013/0048755 | A1 * | 2/2013 | Uehira | B05B 11/3087 239/318 |
| 2014/0054330 | A1 | 2/2014 | Feriani et al. | |
| 2014/0061247 | A1 | 3/2014 | Arminak et al. | |
| 2015/0043958 | A1 | 2/2015 | Painchaud et al. | |
| 2017/0265691 | A1 * | 9/2017 | Ophardt | F04B 53/14 |
| 2018/0208368 | A1 | 7/2018 | Lee | |
| 2021/0000306 | A1 * | 1/2021 | Arminak | B05B 7/0037 |

OTHER PUBLICATIONS

Extended European Sear Report dated Aug. 31, 2021; European Patent Application No. 19738779.8 filed Jul. 15, 2020.

* cited by examiner

REDUCED FORCE, SEALING VENT FOR SQUEEZE FOAMER

CROSS-REFERENCE TO RELATED APPLICATIONS

This application is a 35 U.S.C. 371 national stage filing of PCT Application No. PCT/US2019/012670 filed on Jan. 8, 2019, which claims priority to U.S. Provisional Patent Application 62/615,041 filed on Jan. 9, 2018, each of which are hereby incorporated by reference in their entirety.

TECHNICAL FIELD

The present invention relates generally to foaming dispenser for squeezable containers, and, more specifically, to a venting seal closure associated with such dispensers.

BACKGROUND

An increasing number of liquid products, including soaps, cleaning solutions, and other fluids, find enhanced utility when dispensed from a container as a foam. Consequently, a wide array of containers having foaming dispensers are now available.

Generally speaking, foaming dispensers rely upon mixing the liquid fluid with a corresponding (and usually predetermined) volume of air in a specially designed mixing chamber. The liquid and air can be urged into the chamber by way of a pump mechanism. However, one drawback to these mechanisms is that they often require a number of specially designed parts, which can increase costs and/or the likelihood of a failure in one of the components.

As a result, a number of dispensers discharge foam by a simple squeeze action applied to the sidewalls of a deformable, resilient container. This squeezing urges the liquid into the mixing chamber while simultaneously allowing air to be drawn in through vents/inlets formed in the container, usually in or proximate to its cap (where the foaming mechanism is typically located).

FIG. 1 generically illustrates a foaming dispenser associated with a typical squeeze container. Dispenser 10 includes a cap 20 positioned over the closure 30 and dispenser nozzle 40. When the cap is removed, air inlets 35 formed permit make-up air to re-enter the container (not shown) after a squeezing action. In particular, liquid from the container is urged past the valve 42 by way of inner flaps 43 deflecting upward. The liquid then enters the foaming chamber 46 and is urged out of the nozzle outlet 48. The resilient sidewalls of the container (not shown) expand, drawing the outer flaps 44 downward and allowing air to pass back into the container's interior. Other, similar approaches to foaming valves can be found in U.S. Pat. Nos. 8,360,282 and 9,718,070.

In these designs, the valve includes resilient, deformable flaps that are temporarily displaced to permit the temporary flow of air or liquid. As shown in FIG. 1, these flaps attach to an annular upstanding wall so that the flaps effectively possess rigidity and hoop strength. In fact, the upstanding wall is in the form of an circular cylinder that defines a fluidic barrier with the nozzle structure 40, so that the liquid/foam outlet (as defined by chamber 46 and outlet 48) remains separated from the air inlets 35. In this manner, the flaps 43, 44 attach on opposing sides of the wall at a midpoint so as to allow each flap 43 or 44 to flex and deform. While this hoop strength ensures a good seal, it also creates significant force which must be overcome to activate the squeeze foamer.

Through finite element analysis, the inventors have discovered the upward slope of flaps 43, 44 requires a moderate amount of force, as an example, in the range of approximately 10 N. While it is important for the deformable vent to have sufficient strength to avoid unintended activation/foaming, many users would prefer a slightly easier to activate foaming mechanism. More specifically, a vent seal that deformed with less force would be welcome. Also, the strength/stiffness of previous vent designs contributed to relatively loud operation of the foamer (i.e., the excessive force to activate also created more noise).

SUMMARY

A sealing vent for a foaming dispenser associated with a squeeze foaming container is described. The vent has an annular structure, with a central aperture encased by a multi-tiered disc section connected to inner facing of a thickened, axial wall. An upward angled, outer flange is connected on an outer facing of the axial wall, and the outer flange is attached at a lower elevation along the axial wall in comparison to the disc section.

Specific reference is made to the appended claims, drawings, and description below, all of which disclose elements of the invention. While specific embodiments are identified, it will be understood that elements from one described aspect may be combined with those from a separately identified aspect. In the same manner, a person of ordinary skill will have the requisite understanding of common processes, components, and methods, and this description is intended to encompass and disclose such common aspects even if they are not expressly identified herein.

DESCRIPTION OF THE DRAWINGS

Operation of the invention may be better understood by reference to the detailed description taken in connection with the following illustrations. These appended drawings form part of this specification, and any information on/in the drawings is both literally encompassed (i.e., the actual stated values) and relatively encompassed (e.g., ratios for respective dimensions of parts). In the same manner, the relative positioning and relationship of the components as shown in these drawings, as well as their function, shape, dimensions, and appearance, may all further inform certain aspects of the invention as if fully rewritten herein. Unless otherwise stated, all dimensions in the drawings are with reference to inches, and any printed information on/in the drawings form part of this written disclosure. Also, the objects in the drawings are shown in their intended orientation, so that a feature shown in the top of the drawings are oriented toward the upper or topside portion of the mechanism/object, while features at or facing downward likewise at the bottom or underside portion.

In the drawings and attachments, all of which are incorporated as part of this disclosure.

DETAILED DESCRIPTION

Reference will now be made in detail to exemplary embodiments of the present invention, examples of which are illustrated in the accompanying drawings. It is to be understood that other embodiments may be utilized and structural and functional changes may be made without departing from the respective scope of the invention. As such, the following description is presented by way of illustration only and should not limit in any way the various alternatives and modifications that may be made to the illustrated embodiments and still be within the spirit and scope of the invention.

As used herein, the words "example" and "exemplary" mean an instance, or illustration. The words "example" or "exemplary" do not indicate a key or preferred aspect or embodiment. The word "or" is intended to be inclusive rather an exclusive, unless context suggests otherwise. As an example, the phrase "A employs B or C," includes any inclusive permutation (e.g., A employs B; A employs C; or A employs both B and C). As another matter, the articles "a" and "an" are generally intended to mean "one or more" unless context suggest otherwise.

Figure 1:
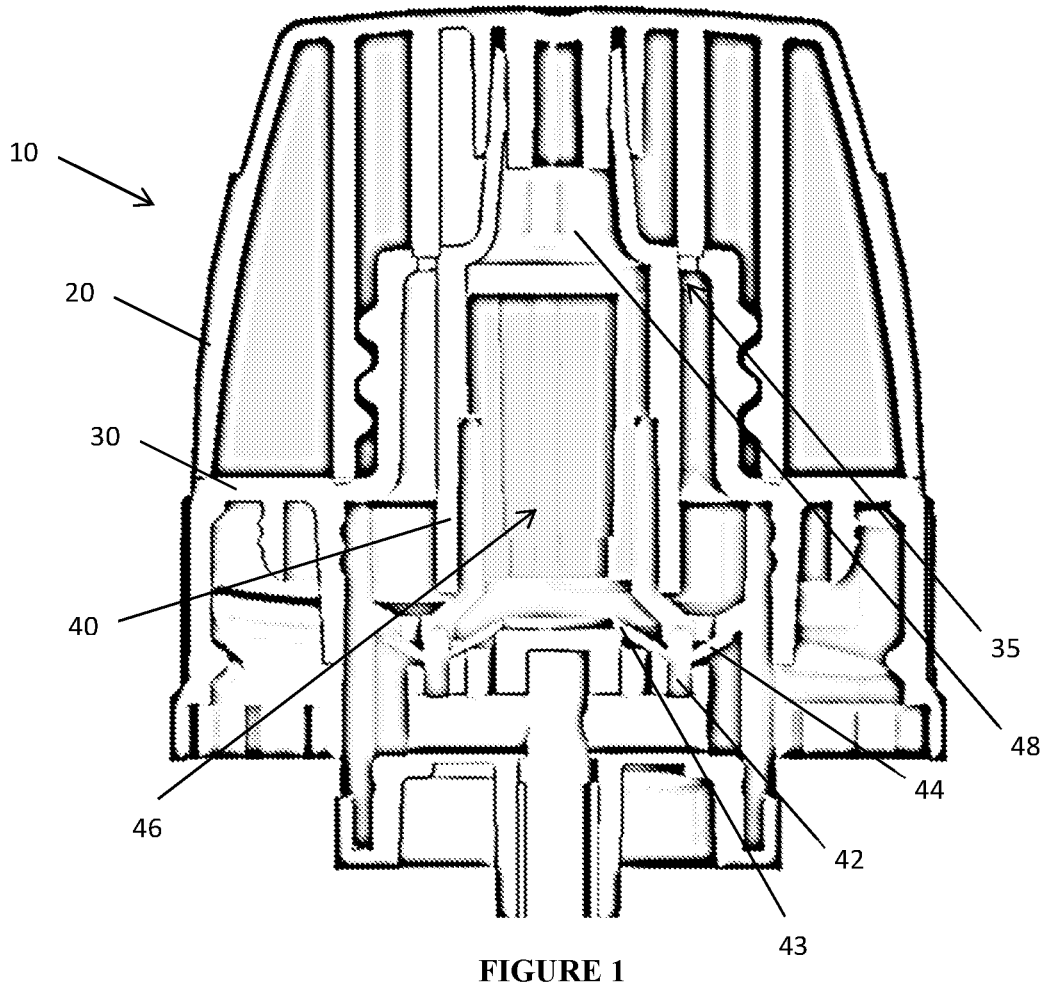
FIGURE 1 PRIOR ART
FIG. 1 is a cross sectional side view of a foaming dispenser including a vent seal.
Figure 2:
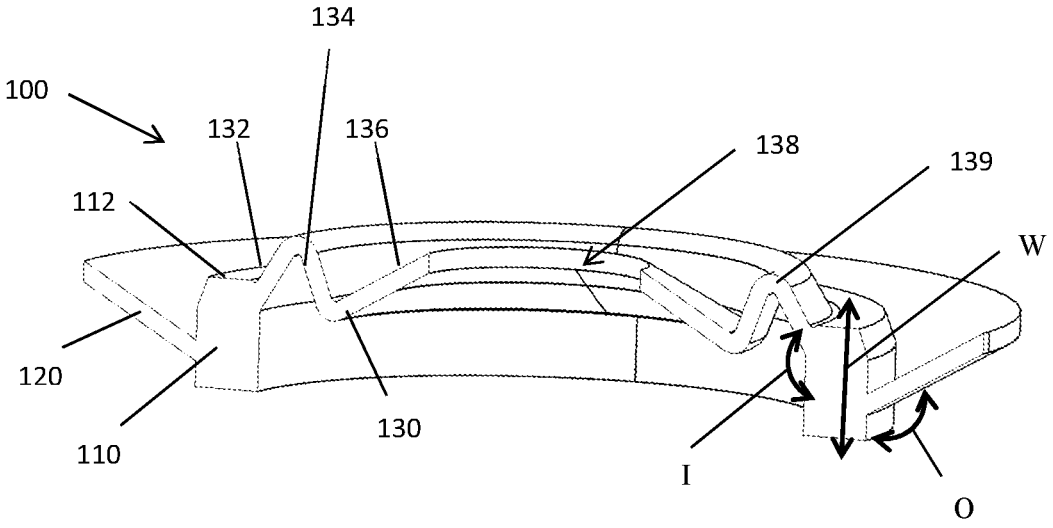
FIG. 2 is a cross sectional, perspective, side view of one embodiment of the vent seal according to the invention.
Figure 3A:
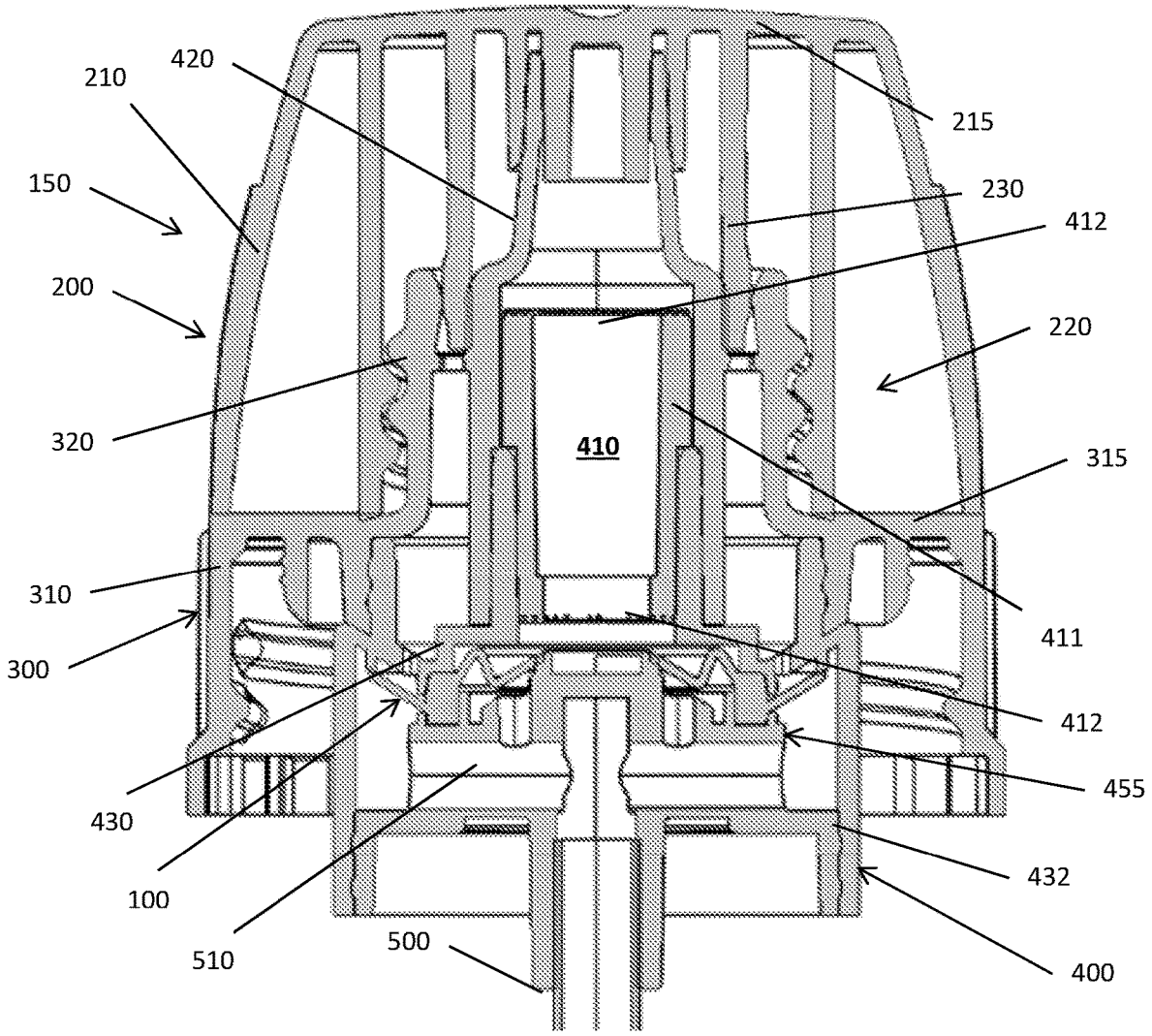
FIG. 3A is a cross sectional side view of the overcap, closure, nozzle outlet, and vent seal of FIG. 2.
Figure 3B:
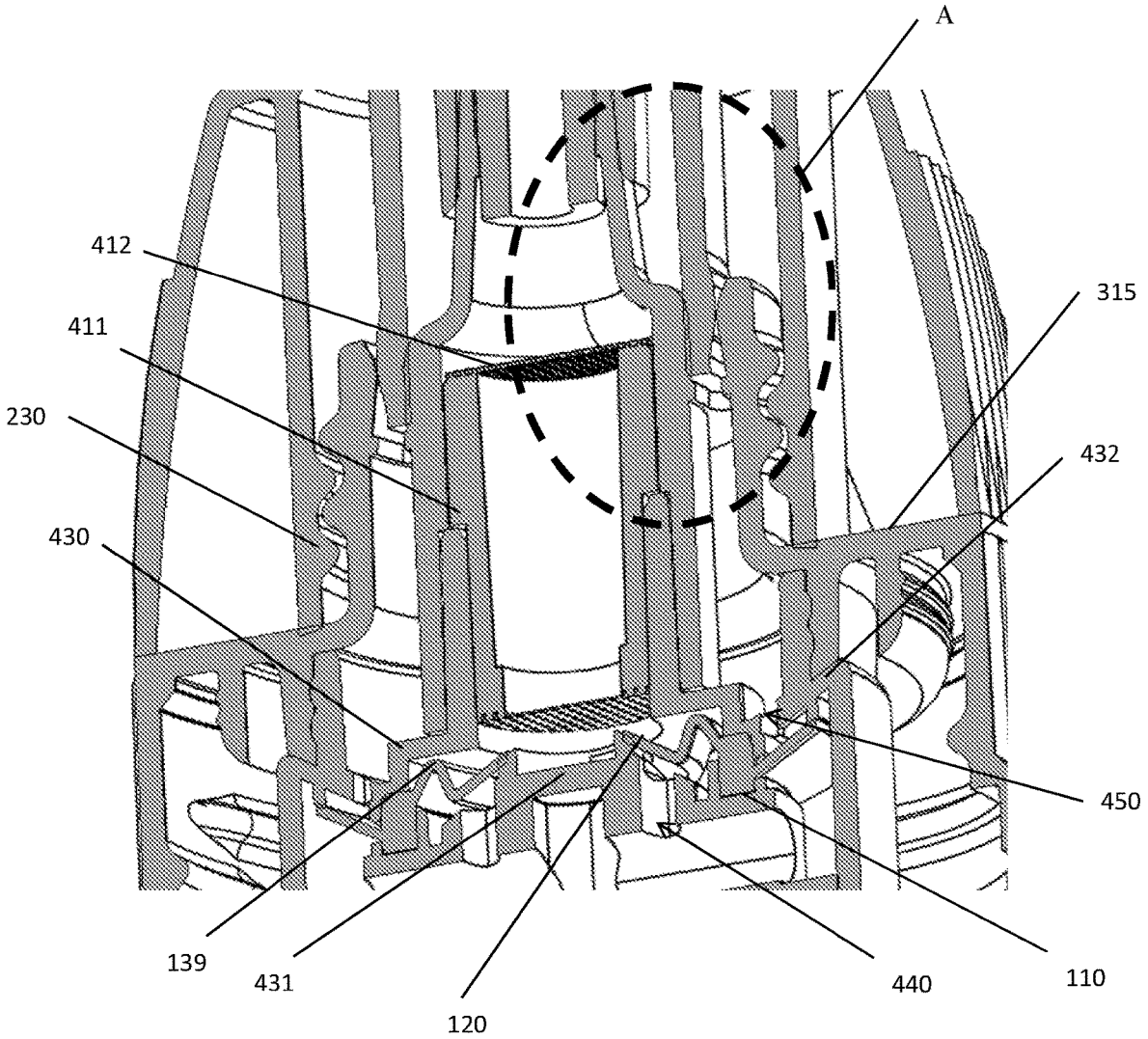
FIG. 3B is a cross sectional, perspective side view of the arrangement in FIG. 2.
Figure 3C:
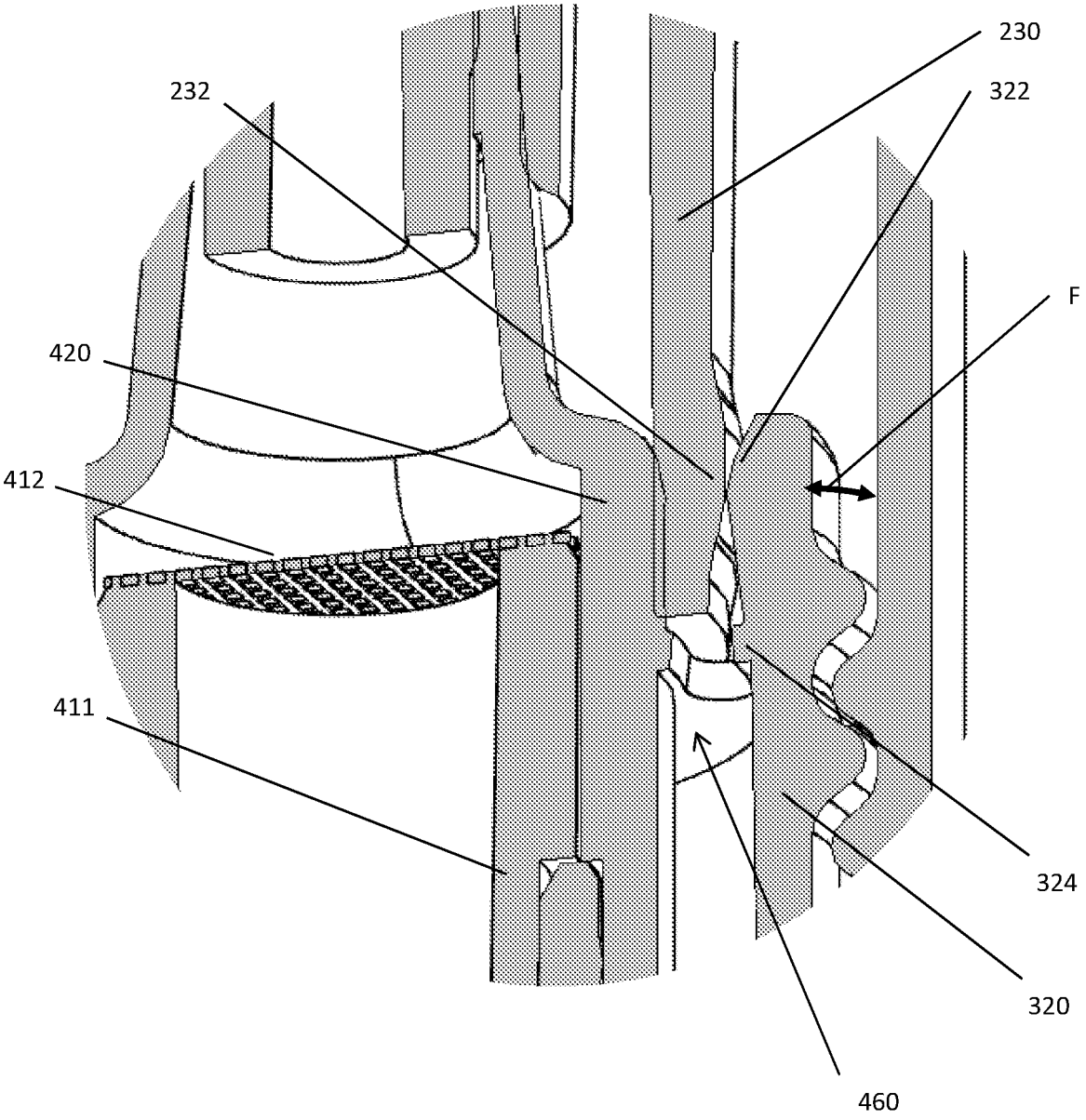
FIG. 3C is a cross sectional, perspective side view of callout A from FIG. 3B, highlighting sealing surface formed between the overcap, the closure, and the nozzle.

With reference to FIGS. 2 through 3C, the inventor has discovered that providing a vent seal with a multi-tiered disc concentrically disposed within and attached to the thickened axial wall requires less force to activate a squeeze foaming dispenser, like the ones shown in FIG. 1 and/or the patents cited above. The vent 100 has a cylindrical wall 110 with angled discs or flaps 120, 130 projecting out from opposing sides of that wall 110. An aperture 138 remains in the center. The inner flap has at least three separate sloping portions 132, 134, 136 disposed at differing angles, so as to facilitate the movement required of the vent during activation (i.e., squeeze foaming). Further, the attachment points for the inner and outer flaps are at different elevations (relative to wall axis W) along the wall 110, as well as attachment angles I, O relative to the wall axis. Preferably, the inner disc 120 will be attached at a higher elevation along the inner facing of the wall 110 in comparison to flap 130, while angle I is greater than angle O. This combination of features results in a flap that forms a good, resilient seal with lower activation force required in comparison to the unitary flaps described above.

In operation, the outer most flap 130 engages a sealing surface on dispenser structure 400, as described below. As above, flap 130 will be drawn inward during activation, thereby admitting make-up air into the sealed container.

Further, the multi-tiered combination of portions 132, 134, 136 reduce the initial hoop strength necessary for activation. In particular, with reference to the angles formed on the underside of vent 100 as it is pictured in FIG. 2, the joint of sections 132, 134 forms an acute angle with a peak 139 that extends to an axial elevation above the top edge 112 of wall 110. In turn, the joint of sections 134, 136 forms an obtuse angle with section 136 forming a frusto-conical shape that angles upward. In comparison, the terminal, outer-most edge of flap 120 is above even with the top edge of wall 110, and it also remains disposed at an upward angle.

The disc portion is multi-tiered. That is, the disc contains three, distinct ramping sections. A ramp section is an angled, inwardly extending annulus. Each ramp section is oriented at a distinct angle relative to any ramp section or sections attached adjacent to it, thereby making each section easily identifiable. Although not intending to be limited by any theory of operation, the distinct angles of these ramp sections may act as hinges to facilitate the upward and downward movement of the inner disc. This facilitated movement, in turn, lowers the activation force required in comparison to the prior art design described above. Additionally, the intersection of at least two of the ramping sections may engage a portion of the nozzle and/or closure body to hold the vent in place and, in some instances, to provide further leverage in facilitating the movement of the vent to admit liquid (as shown in FIG. 3B) into the foaming chamber.

Thus, the axial wall is formed integrally with the flange and inner disc. However, if considered as a discrete element, the wall can be visualized as a hollow cylinder. The thickness of this wall (i.e., in the radial direction) should be greater than the thickness of either the flange or the inner disc (i.e., in the axial direction). This increased thickness provides the necessary strength and lever-action associated with squeeze foaming activation. The cylinder may have flattened top and/or bottom portions to engage the foaming mechanism. Also, the cross sectional profile of the wall may be consistent or it may allow for one or both terminal ends to taper inward. Preferably, the top terminal end of the cylinder tapers so that the overall thickness of the wall at the flattened end is less than the thickness where the inner disc and/or flange are attached.

The vent 100 is integrated within a dispenser 150 and, more particularly, in conjunction with a nozzle structure 400 that may be connected to (e.g., by way of a threaded engagement mechanism) a closure body 300. Closure body 300 is formed to be attachable to a container neck to seal a squeezable or resilient container (not shown). An overcap 200 is provided as part of dispenser 150, with the overcap engaging the closure body 300 and nozzle structure 400 to seal the dispenser 150 when it is not in use. The top panel 215 of the overcap 200 may include one or more concentrically formed sealing cylinder 230. Such cylinders 230 protrude axially into the cavity to engage and/or seal specific portions of the closure 300 and nozzle 400, as will be described below.

Overcap 200 includes an outer sidewall 210. Sidewall 210 extends axially downward to define a cylinder, with the interior cavity 220 of that cylinder hollowed out to receive the closure 300 and/or nozzle 400.

Closure body 300 has a cylindrical shape, preferably with a series of progressively inset cylinder sections 310, 320 connected by a radial skirt section 315. Threads or engagement mechanisms may be provided on the inner or outer circumference of the sections 310, 320 to attach the closure 300 to any one of the container, the overcap 200, and/or the nozzle 400. Additionally, one or more concentric cylinders can be formed on either side of the skirt 315 for engagement and/or support.

A nozzle structure 400 is integrated with the closure body 300. For example, structure 400 may comprise a single or multi-piece set of cylinders fitted within the central axis of the body 300. At a minimum, structure 400 incorporates a foaming chamber 410, bounded on its top and bottom by mesh inserts 412. A nozzle outlet 420 receives the cylindrical body 411 of the foaming chamber along the top end of the body 411. Chamber 410 is fluidically connected to the interior of the container to receive liquid therefrom and to expel a foamed product out of the nozzle outlet 420 when squeeze-dispensing occurs (which is, itself, only possible when the overcap 200 is removed). As used herein, "dispensing condition" refers to the flexing, depressing, or squeezing the sidewalls of the container so as to force liquid to flow up from the interior of the container and into the dispenser 150, after which the resilient nature of the container creates sufficient suction to draw make-up air back into the container via the dispenser 150.

Conversely, along the bottom of body 411, a cyldinrical housing 430 is attached or fitted into place. Housing 430 cooperates with a bottom plate 431 and/or an attachment cylinder 432 to retain the vent 100 within the dispenser 150. In some embodiments, the peak 139 formed by/between ramped sections 132, 134 rests on an underside of the housing 430 (at least during dispensing/squeezing), while the inner flap 120 seals with the bottom plate 431 to close off the liquid/foam duct 440. In the same manner, outer flap 130 sealingly engages the bottom plate to close off the air duct 450, while the contact between the peak 139 and the housing 430 facilitates the opening of the inner flap to admit liquid into the foaming chamber (thereby reducing the amount of force required to activate the dispenser).

A dip tube 500 connects to a transverse duct 510. The duct 510 terminates at its most radially distant point in an annular air chamber 455 positioned proximate to the underside of flap 130. Duct 510 includes apertures leading to liquid/foam duct 440. The dip tube 500 itself extends well into the interior of the container to accommodate the flow of air and liquid during the dispensing and air-make/recovery aspects of dispensing, in a manner well known to those in the art. As used herein, the interior of the container abuts the underside of the nozzle 400, while the top of the nozzle includes the nozzle outlet 420. Thus, when the overcap 200 is selectively removed (e.g., by way of a screw top or snap-fitting), the outlet 420 is exposed to the exterior environment so that foam can be expelled from the dispenser 150 during a dispensing condition.

The integration and, preferably, concentric positioning of the nozzle 400 within the closure body 300 creates an annular gap 460 fluidically connect to the air inlet and duct 450 that is sealed by vent 100. A terminal edge of cylindrical wall 230 fits within the gap 460 so as to effectively seal the air inlet when the overcap 200 is attached to the dispenser 150. To facilitate its insertion and engagement, circumferential protrusions 232, 322 are provided to opposing facings of the cylinders 230 and 320. The protrusions 232, 322 act as guide ramps to facilitate the mating of the overcap 200 to the closure body 300. One or a pair of stops 324 may extend radially into gap 460 to further assist in this regard. Cylinder 320 may flex outwardly along line F during this operation.

In view of the foregoing, a vent according to this invention may include any combination of the following elements: an upright axial wall having a hollow cylindrical shape; an inner flap comprising three contiguous sections attached to an inner facing of the axial wall, said three contiguous sections each sloped at a discrete angle relative to the upright axial wall; an outer flap attached to an outer facing of the axial wall; a central aperture defined by a terminal edge of the inner flap; wherein the inner flap and the outer flap are attached to the axial wall at differing elevations relative to one another; wherein a first sloping section of the inner flap is attached to the upright wall at an acute angle and a second sloping section, disposed between the first and a third sloping section, is at an obtuse angle; wherein the first and third sloping sections are disposed in an upward direction and the second sloping section is disposed in a downward direction; wherein a junction of the first and second sloping sections is at an elevation above a terminal top edge of the upright axial wall; and wherein an angle of attachment between the inner flap and the axial wall is different from an angle of attachment between the outer flap and the axial wall.

In the same manner, a closure for squeeze-activated container having flexible and/or resilient walls is also contemplated. It may incorporate the vent of the preceding paragraph, along with any combination of the following features: a closure body; a nozzle structure, carried within the closure body, having a foaming chamber connected to a nozzle outlet; the vent positioned within the nozzle structure, wherein the inner flap is proximate to the foaming chamber and wherein the outer flap is proximate to an air inlet formed between the nozzle structure and the closure body; an overcap having an interior cavity defined by a peripheral sidewall extending downward from a top panel and wherein the overcap is selectively attached to at least one of the closure and the nozzle structure; wherein the overcap includes a sealing cylinder extending axially downward within the interior cavity and wherein the sealing cylinder is received within a circumferential gap proximate to the air inlet defined by the nozzle structure and the closure; wherein a circumferential surface proximate to a terminal end of the sealing cylinder has an engagement protrusion; wherein an outer wall of the circumferential gap includes an engagement protrusion extending into the circumferential gap; wherein the outer wall resiliently flexes radially outward to receive a portion of the sealing cylinder; wherein the inner flap selectively seals a liquid flowpath from an underside of the nozzle structure through the foaming chamber to the nozzle outlet and wherein the outer flap selectively seals an air flowpath from the air inlet to the underside of the nozzle structure; a dip tube connected to the nozzle structure and wherein the dip tube forms part of the air flowpath; a ball valve is positioned within the dip tube to selectively seal the air flowpath and wherein the ball valve is urged into an open position when the container is subjected to a dispensing condition; wherein the nozzle structure includes an annular air chamber forming part of the air flowpath, said air chamber is selectively sealed by the inner flap; and wherein a transverse duct forms part of the liquid and air flowpaths, said transverse duct connecting to the dip tube.

In the alternative, a closure for squeeze-activated container having flexible and/or resilient walls incorporates the combination of vent arrangements noted above, along with any the following: the vent positioned within the nozzle structure, wherein the junction of the inner flap comes into contact a surface of the nozzle structure to facilitate opening the liquid flowpath during a dispensing condition; wherein the inner flap selectively seals a liquid flowpath from an underside of the nozzle structure through the foaming chamber to the nozzle outlet and wherein the outer flap selectively seals an air flowpath from the air inlet to the underside of the nozzle structure wherein the outer flap is proximate to an air inlet formed between the nozzle structure and the closure body and selectively seals an air flowpath from the air inlet to the underside of the nozzle structure; an overcap having an interior cavity defined by a peripheral sidewall extending downward from a top panel and a sealing cylinder extending axially downward within the interior cavity and wherein the sealing cylinder is received within a circumferential gap proximate to the air inlet defined by the nozzle structure and the closure; wherein a circumferential surface proximate to a terminal end of the sealing cylinder has an engagement protrusion; and wherein an outer wall of the circumferential gap includes an engagement protrusion extending into the circumferential gap and wherein the outer wall resiliently flexes radially outward to receive a portion of the sealing cylinder.

All components should be made of materials having sufficient resilience, flexibility, and structural integrity, as well as a chemically inert nature. As used herein, resilience refers to a structure's ability to return to its original shape, which may include the ability to exert sufficient force to create pressure differentials within a confined space (e.g., the interior of the container). The materials should also be selected for workability, cost, and weight. Common polymers amenable to injection molding, extrusion, or other common forming processes should have particular utility. Any container of sufficient resilience and flexibility can be associated with this design.

Although the present embodiments have been illustrated in the accompanying drawings and described in the foregoing detailed description, it is to be understood that the invention is not to be limited to just the embodiments disclosed, and numerous rearrangements, modifications and substitutions are also contemplated. The exemplary embodiment has been described with reference to the preferred embodiments, but further modifications and alterations encompass the preceding detailed description. These modifications and alterations also fall within the scope of the appended claims or the equivalents thereof.

What is claimed is:

1. An annular vent for selectively admitting air into a squeeze foaming mechanism when the mechanism is activated, the vent comprising:

an wall having a hollow cylindrical shape aligned along a substantially vertical axis;

an inner flap comprising first, second, and third contiguous sections attached to an inner facing of the wall with the first contiguous section attached to the wall at an angle and the first and second contiguous sections are joined at an elevation above a terminal top edge of the wall;

an outer flap attached to an outer facing of the wall; and a central aperture defined by a terminal edge of the third contiguous section of the inner flap.

2. The vent of claim 1 wherein the inner flap and the outer flap are attached to the wall at differing elevations relative to one another.

3. The vent of claim 2 wherein the first and second contiguous sections are joined at an acute angle and the second and third contiguous sections are joined at an obtuse angle.

4. The vent of claim 1 wherein the first and third sloping sections are disposed in an upward direction and the second sloping section is disposed in a downward direction.

5. The vent of claim 4 wherein an angle of attachment between the inner flap and the wall is different from an angle of attachment between the outer flap and the wall.

6. The vent of claim 1 wherein an elevation and angle of attachment between the inner flap and the wall is different from an elevation and angle of attachment between the outer flap and the wall.

7. A closure for a squeeze-activated foaming dispenser comprising:

a closure body;

a nozzle structure, carried within the closure body, having a foaming chamber connected to a nozzle outlet;

the vent of claim 1, positioned within the nozzle structure, wherein the inner flap is proximate to the foaming chamber and wherein the outer flap is proximate to an air inlet formed between the nozzle structure and the closure body.

8. The closure of claim 7 further comprising an overcap having an interior cavity defined by a peripheral sidewall extending downward from a top panel and wherein the overcap is selectively attached to at least one of the closure and the nozzle structure.

9. The closure of claim 8 wherein the overcap includes a sealing cylinder extending axially downward within the interior cavity and wherein the sealing cylinder is received within a circumferential gap proximate to the air inlet defined by the nozzle structure and the closure.

10. The closure of claim 9 wherein a circumferential surface proximate to a terminal end of the sealing cylinder has an engagement protrusion.

11. The closure of claim 10 wherein an outer wall of the circumferential gap includes an engagement protrusion extending into the circumferential gap.

12. The closure of claim 11 wherein the outer wall resiliently flexes radially outward to receive a portion of the sealing cylinder.

13. The closure of claim 7 wherein the inner flap selectively seals a liquid flowpath from an underside of the nozzle structure through the foaming chamber to the nozzle outlet and wherein the outer flap selectively seals an air flowpath from the air inlet to the underside of the nozzle structure.

14. The closure of claim 13 further comprising a dip tube connected to the nozzle structure and wherein the dip tube forms part of the air flowpath.

15. The closure of claim 14 further comprising a ball valve is positioned within the dip tube to selectively seal the air flowpath and wherein the ball valve is urged into an open position when the container is subjected to a dispensing condition.

16. The closure of claim 13 wherein the nozzle structure includes an annular air chamber forming part of the air flowpath, said air chamber is selectively sealed by the inner flap.

17. The closure of claim 13 wherein a transverse duct forms part of the liquid and air flowpaths, said transverse duct connecting to the dip tube.

18. A closure for a squeeze-activated foaming dispenser comprising:

a closure body;

a nozzle structure, carried within the closure body, having a foaming chamber connected to a nozzle outlet;

the vent of claim 1, positioned within the nozzle structure, wherein the junction of the inner flap comes into contact a surface of the nozzle structure to facilitate opening the liquid flowpath during a dispensing condition;

wherein the inner flap is proximate to the foaming chamber and selectively seals a liquid flowpath from an underside of the nozzle structure through the foaming chamber to the nozzle outlet; and wherein the outer flap is proximate to an air inlet formed between the nozzle structure and the closure body and selectively seals an air flowpath from the air inlet to the underside of the nozzle structure.

19. The closure of claim 18 further comprising an overcap having an interior cavity defined by a peripheral sidewall extending downward from a top panel and a sealing cylinder extending axially downward within the interior cavity and wherein the sealing cylinder is received within a circumferential gap proximate to the air inlet defined by the nozzle structure and the closure.

20. The closure of claim 19 wherein a circumferential surface proximate to a terminal end of the sealing cylinder has an engagement protrusion.

21. The closure of claim 20 wherein an outer wall of the circumferential gap includes an engagement protrusion extending into the circumferential gap and wherein the outer wall resiliently flexes radially outward to receive a portion of the sealing cylinder.

22. An annular vent for selectively admitting air into a squeeze foaming mechanism when the mechanism is activated, the vent comprising:

an wall having a hollow cylindrical shape aligned along a substantially vertical axis;

an outer flap attached to an outer facing of the wall;

an inner flap attached to an inner facing of the wall at a different elevation in comparison to the outer flap, the inner flap having first, second, and third contiguous sections where the first contiguous section is attached to the wall, the second contiguous section is disposed at a downward angle relative to the first and third contiguous sections, and the third contiguous section forms an upwardly angled, frusto-conical shape with a terminal edge defining a central aperture having an axial elevation relative to the wall that falls between that of: (i) a junction of the first and second contiguous sections and (ii) a junction of the second and third contiguous sections.

* * * * *